US007215296B2

(12) United States Patent
Abramov et al.

(10) Patent No.: US 7,215,296 B2
(45) Date of Patent: May 8, 2007

(54) SWITCHED MULTI-BEAM ANTENNA

(75) Inventors: Oleg Yurievich Abramov, St. Petersburg (RU); David B. Robison, Carlsbad, CA (US); Jeffrey K. Shamblin, San Marcos, CA (US); Farid Ibragimovich Nagaev, St Petersburg (RU); Pertti J. Visuri, Fallbrook, CA (US)

(73) Assignee: Airgain, Inc., Carlsbad, CA (US)

( * ) Notice: Subject to any disclaimer, the term of this patent is extended or adjusted under 35 U.S.C. 154(b) by 8 days.

(21) Appl. No.: 11/104,291

(22) Filed: Apr. 12, 2005

(65) Prior Publication Data

US 2005/0237258 A1 Oct. 27, 2005

Related U.S. Application Data

(63) Continuation-in-part of application No. 10/510,157, filed on Oct. 5, 2004.

(60) Provisional application No. 60/562,097, filed on Apr. 12, 2004.

(51) Int. Cl.
*H01Q 19/10* (2006.01)

(52) U.S. Cl. ..... 343/834; 343/853; 343/846

(58) Field of Classification Search ..... 343/700 MS, 343/815, 817, 818, 819, 833, 834, 846, 853, 343/835

See application file for complete search history.

(56) References Cited

U.S. PATENT DOCUMENTS 3,790,943 A * 2/1974 Pickles et al. ..... 342/399
4,290,071 A * 9/1981 Fenwick ..... 343/819
4,631,546 A 12/1986 Dumas et al.
4,700,197 A 10/1987 Milne
5,220,335 A 6/1993 Huang
5,235,343 A 8/1993 Audren et al.
5,294,939 A 3/1994 Sanford et al.
5,479,176 A 12/1995 Zavrel, Jr.
5,617,102 A 4/1997 Prater
5,767,807 A 6/1998 Pritchett
5,905,473 A 5/1999 Taenzer
5,949,379 A 9/1999 Yang
6,034,638 A * 3/2000 Thiel et al. ..... 343/702
6,037,905 A 3/2000 Koscica et al.
6,285,328 B1 9/2001 Masaki et al.
6,337,668 B1 * 1/2002 Ito et al. ..... 343/833
6,407,717 B2 6/2002 Killen et al.
6,515,635 B2 2/2003 Chiang et al.

FOREIGN PATENT DOCUMENTS

EP 1063789 12/2000
SU 1488898 6/1989

* cited by examiner

*Primary Examiner*—Tan Ho
(74) *Attorney, Agent, or Firm*—Procopio, Cory, Hargreaves & Savitch

(57) ABSTRACT

An antenna assembly includes a common reflector and multiple monopole type antenna elements positioned on a ground plane and fed with a switch assembly. The switch assembly is capable of feeding individual antennas as well as combining multiple antennas for improved radiation pattern coverage. Multiple antenna elements are placed around the common reflector to cover sectors of space around the antenna assembly to provide transmission and reception of radio frequency (RF) signals for mobile communication devices in a wireless network. The ground plane can be grounded or capacitively coupled to an existing circuit board or metal surface, allowing for reduced ground plane dimensions.

15 Claims, 9 Drawing Sheets

Figure 4A-E

SWITCHED MULTI-BEAM ANTENNA

RELATED APPLICATIONS

This application claims the benefit of U.S. Provisional Application No. 60/562,097 filed Apr. 12, 2004, entitled MONOPOLE YAGI ANTENNA ARRAYS UTILIZING A COMMON REFLECTOR and is a Continuation-in-Part of U.S. application Ser. No. 10/510,157, filed Sep. 27, 2004, titled: AN ANTENNA SYSTEM WITH A CONTROLLED DIRECTIONAL PATTERN, A TRANSCEIVER AND A NETWORK PORTABLE COMPUTER (which claimed the benefit of PCT/RU03/00119 filed Mar. 24, 2003 and Russian application 2002108661 filed Mar. 27, 2002). Each of the foregoing applications are hereby incorporated by reference.

FIELD OF THE INVENTION

This invention relates to wireless communication systems including direction-agile antennas useful in such systems.

BACKGROUND OF THE INVENTION

In wireless communication systems, antennas are used to transmit and receive radio frequency signals. In general, the antennas can be omni-directional or unidirectional. In addition, there exist antenna systems which provide directive gain with electronic scanning rather than being fixed. However, many such electronic scanning technologies are plagued with excessive loss and high cost. In addition, many of today's wireless communication systems provide very little room for antennae elements.

Traditional Yagi-Uda arrays consist of a driven element (by this we mean a signal is fed to the element by a transmitter or other signal source), called the driver or antenna element, a reflector, and one or more directors. The reflector and directors are not driven, and are therefore parasitic elements. By choosing the proper length and spacing of the reflector from the driven element, as well as the length and spacing of the directors, the induced currents on the reflector and directors will re-radiate a signal that will additively combine with the radiation from the driven element to form a more directive radiated beam compared to the driven element alone. The most common Yagi-Uda arrays are fabricated using a dipole for the driven element, and straight wires for the reflector and directors. The reflector is placed behind the driven element and the directors are placed in front of the driven element. The result is a linear array of wires that together radiate a beam of RF energy in the forward direction. The directivity (and therefore gain) of the radiated beam can be increased by adding additional directors, at the expense of overall antenna size. The director can be eliminated, which leads to a smaller antenna with wider beam width coverage compared to Yagi antennas utilizing directors. The dipole element is nominally one-half wavelength in length, with the reflector approximately five percent longer than the dipole and the director or directors approximately five percent shorter than the dipole. The spacing between the elements is critical to the design of the Yagi and varies from one design to another; element spacing will vary between one-eighth and one-quarter wavelength.

SUMMARY OF THE INVENTION

One aspect of the invention includes an antenna system including a reflective layer having an upper surface and a lower surface; a plurality of antenna elements proximate the upper surface of the reflective layer; one or more reflectors electrically coupled to the reflective layer and positioned to operate as a reflector for each of the plurality of antenna elements; and a switch coupled to each of the plurality of antenna elements and configured to select an active state or inactive state for each of the plurality of antenna elements. The switch can be configure to select an active state for more than one antenna element at one time. The reflective layer can comprise a primary reflective surface to which the plurality of antenna elements are located proximate and a secondary reflective surface. A plurality of electrically conductive standoffs can couple the primary reflective surface to the secondary reflective surface. The system can further include a radio coupled to the switch. The radio can be located proximate the lower side of the reflective surface opposite the antenna elements.

Each of the plurality of antenna elements can include a center section coupled to the switch at a first end of the center section proximate the reflective layer; a top section extending from a second end of the center section opposite the first end of the center section; an inductive section extending from the reflective layer to the top section; and a capacitive section extending from the top section towards the reflective layer.

The system can include one or more directors. The directors can be located on the lower surface of the reflective surface. The one or more directors can also be located on the upper surface of the reflective surface.

In another aspect, a communication device includes a base layer; a reflective layer formed on the base layer and having an upper surface and a lower surface; a plurality of antenna elements proximate the upper surface of the reflective layer; one or more reflectors electrically coupled to the reflective layer and positioned to operate as a reflector for each of the plurality of antenna elements; a radio configured to transmit a radio frequency signal; a switch coupled the radio and to each of the plurality of antenna elements and configured to select an active state or inactive state for each of the plurality of antenna elements in response to a control signal; and a controller coupled to the switch and configured generate a control signal to control the switch.

A further aspect of the invention is a method of manufacturing an antenna assembly including providing a base layer having an upper surface and a lower surface; forming a primary reflective surface on the base layer; providing a plurality of antenna elements proximate the upper surface of the base layer; providing one or more reflectors proximate the upper surface of the base layer positioned to operate as a reflector for each of the plurality of antenna elements and electrically coupling the one or more reflectors to the primary reflective surface; and coupling a switch, configured to select an active state or inactive state for each of the plurality of antenna elements in response to a control signal, to each of the plurality of antenna elements. The method can further include matching the impedance of each of the plurality of antenna elements to the switch to minimize losses. Alternatively, The method can include adjusting the impedance of each of the plurality of antenna elements with respect to the switch such that the mismatch loss is equal for the cases when one of the plurality of antenna elements in the active state and when two of the plurality of antenna elements are in the active state. The impedance of an antenna element can be adjusted by shorting one or more impedance tuning pads to the antenna element. In addition, one or more impedance tuning pads can be shorted to each other.

BRIEF DESCRIPTION OF THE DRAWINGS

These and other aspects, advantages and details of the present invention, both as to its structure and operation, may be gleaned in part by a study of the accompanying drawings, in which like reference numerals refer to like parts. The drawings are not necessarily to scale, emphasis instead being placed upon illustrating the principles of the invention.

DETAILED DESCRIPTION OF THE PREFERRED EMBODIMENTS

Certain embodiments as disclosed herein provide for systems and methods for a wireless communication device or system having a switched multi-beam antenna and methods for manufacturing the same. For example, one system and method described herein provides for a plurality of monopole antenna elements mounted on a reflective surface. A common reflector cooperates with each active antenna element to create a directed transmission or a direction of positive gain. A switch allows for activating one or more of the antenna elements to vary the direction of the transmission. All of the antenna elements can be activated to cause the antenna assembly to transmit omni-directionally. Directors above or below the reflective surface can be used to modify the characteristics of the antenna. The system can be used with various wireless communication protocols and at various frequency ranges. For example, the system can be used at frequency ranges including 2.4, Giga hertz, 2.8 Giga hertz, and 5.8 Giga hertz.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1A:
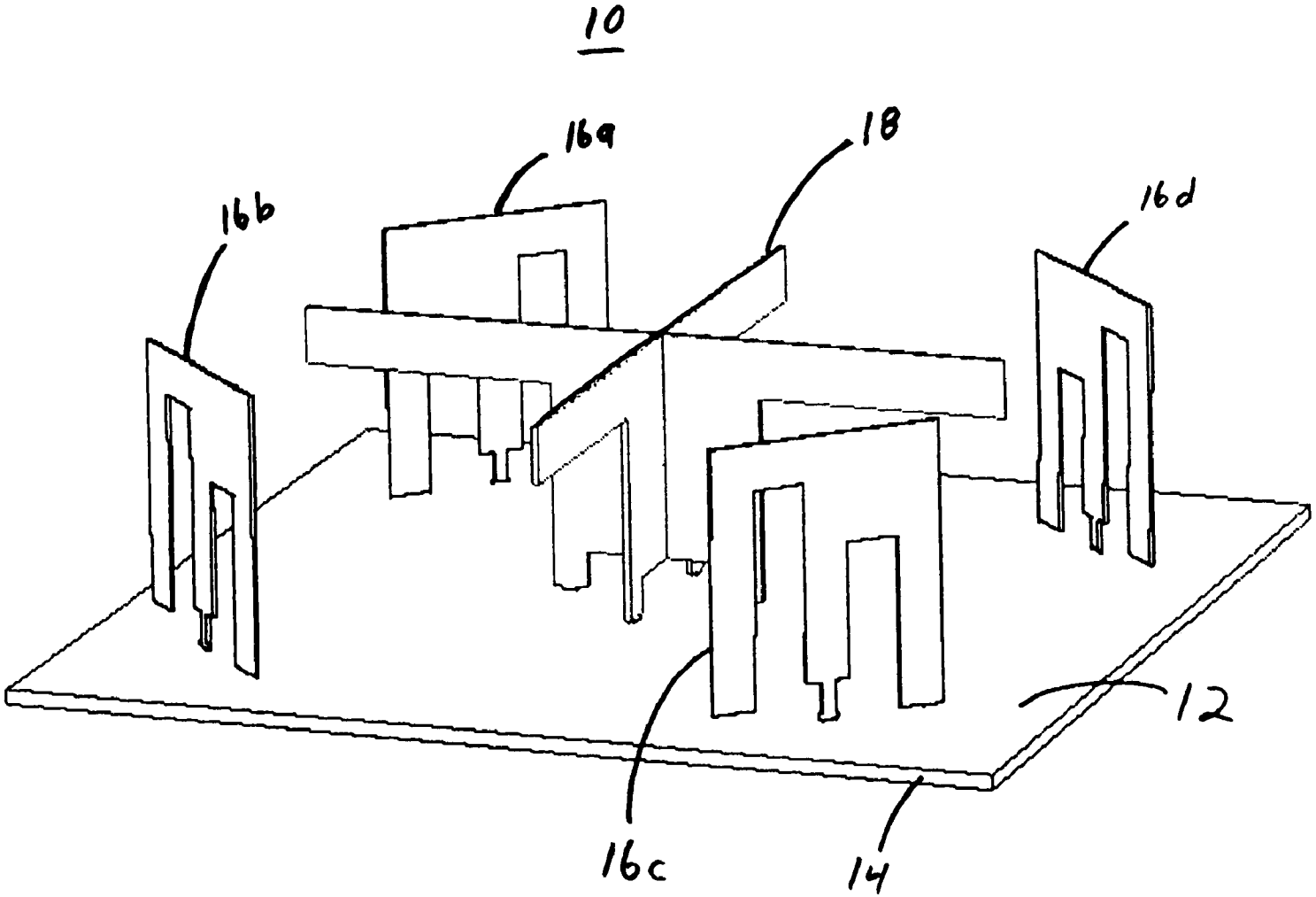
FIG. 1A is a perspective view of a four element antenna assembly.
Figure 1B:
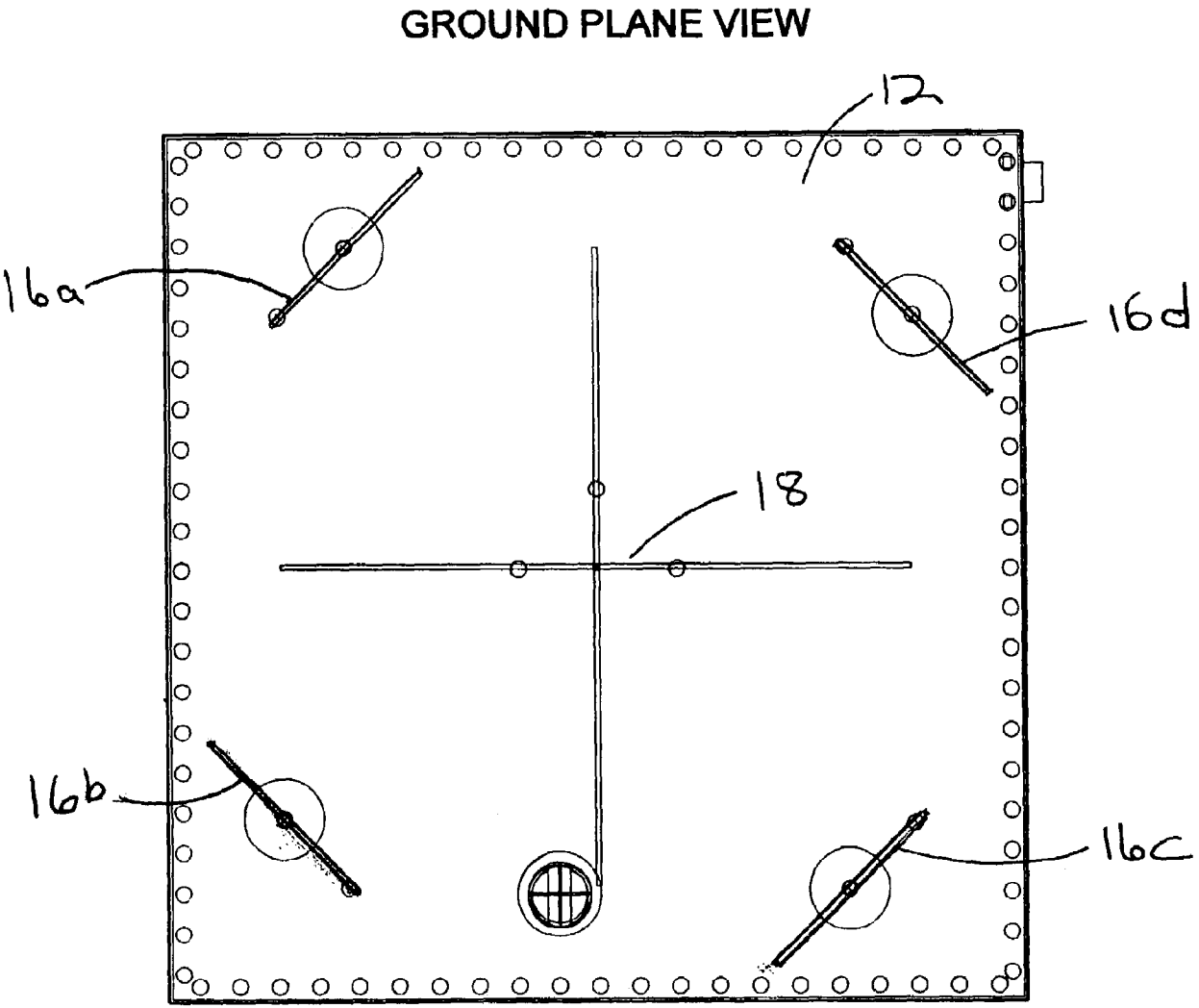
FIG. 1B is a plan view of the antenna assembly shown in FIG. 1A.

FIG. 1A is a perspective view of a four element antenna assembly 10. FIG. 1B is a plan view of the antenna assembly 10. The assembly includes a reflective layer or surface 12 which is reflective to the radio waves with which the antenna assembly will be used. In the embodiment depicted in FIGS. 1A–B, the reflective surface is a ground plane which is formed on the upper surface of a base 14. In this embodiment, the reflective surface 12 covers the entire upper surface of the base 14. The reflective surface 12 can be a layer of copper or other conductive material formed on the base 14. The reflective layer 12 does not necessarily have to be planar. In addition, the reflective surface can have discontinuities. For example, the reflective surface can be a mesh or can have openings. In one embodiment, the size of the discontinuities are one tenth or less of the wavelength to be transmitted. Unless otherwise indicated, references herein to wavelength refer to the wavelength of the radio waves with which the antenna assembly will be used. In one embodiment, the wavelength is between 1 and 12 inches, for example, 10 centimeters.

The base 14 can be a single or multi-layer printed circuit board. In one embodiment, four antenna elements identified as 16*a*, 16*b*, 16*c* and 16*d* are mounted on the base and extend above the reflective surface 12. Alternatively, fewer or more antenna elements can be used. For example, three, five or six antenna elements can be used. Though the antenna elements are shown evenly distributed around the reflective layer, they can be arranged in other patterns. The antenna elements can be, for example, traditional monopoles or folded monopoles. The antenna elements can be formed of copper or other conductive materials.

A reflector element 18 is located centrally with regard to the four monopole elements 16*a–d*. However, the exact location of the reflector 18 can vary. The reflector is mounted to the base 14 and is electrically coupled with the reflective surface 12. In one embodiment, each leg of the reflector is shorted to the reflective surface. The reflector 18 is configured to act as a reflector for each of the monopole elements. Alternatively, more than one reflector can be provided. The reflector elements can be formed of copper or other conductive materials. The reflector 18 can be formed in various shapes. For example, the reflector can be circular or square in cross section. A reflector with a triangular cross section can be used when only three antenna elements are used. A reflector which provides a symmetrical surface to each antenna element is preferred. The reflector is preferably electrically longer in the direction of the polarization of the wave being transmitted than the antenna element with which it works. In order to minimize the physical height of the reflector, it includes four over hangs or arms with cause it to operate as an electrically longer element than its height. The electrical length of the reflector can also be adjusted through the use of lumped impedance between the reflector and the reflective surface.

The assembly depicted in FIGS. 1*a–b* uses a single monopole element to cover a quadrant. The four monopole elements 16*a–d* utilize the common reflector 18. This configuration allows the antenna to provides full coverage in the azimuth plane. The length of wire or material required to form a monopole and reflector (and optionally directors, not shown in this embodiment), is only one-half the length required to form a dipole and reflectors that are not in the vicinity of a reflective surface. When the reflective surface is made sufficiently large, the radiated energy is constrained to the hemisphere above the reflective surface on the side of the reflective surface to which the wire elements (monopoles and reflector) are attached. This allows for placing electronic components or other materials below the reflective surface (the side opposite of the antenna elements) without materially affecting the performance of the antenna assembly. As with traditional Yagi antennae design, the spacing between the elements typically varies between ⅛ and ¼ wavelength. In the embodiment shown in FIGS. 1*a–b*, directors are eliminated in order to provide a smaller antennae structure.

A switch is located on the lower surface of the base 14, opposite the reflective surface 12. The switch 60 is coupled to each of the monopole elements 16*a–d*. The switch can be controlled to select either an active or inactive state for each of the antenna elements 16*a–d*. For example, the switch can selectively apply a driving signal to any one or more of the monopole elements. Driving one of the monopole-type elements with a radio frequency (RF) signal causes that monopole element to radiate the RF signal. Currents are induced on the reflector which re-radiates the RF signal. The length and spacing of the antenna element and the reflector are chosen such that the RF signals radiated from each element in the antennae add constructively in the intended direction of radiation.

Figure 1C:
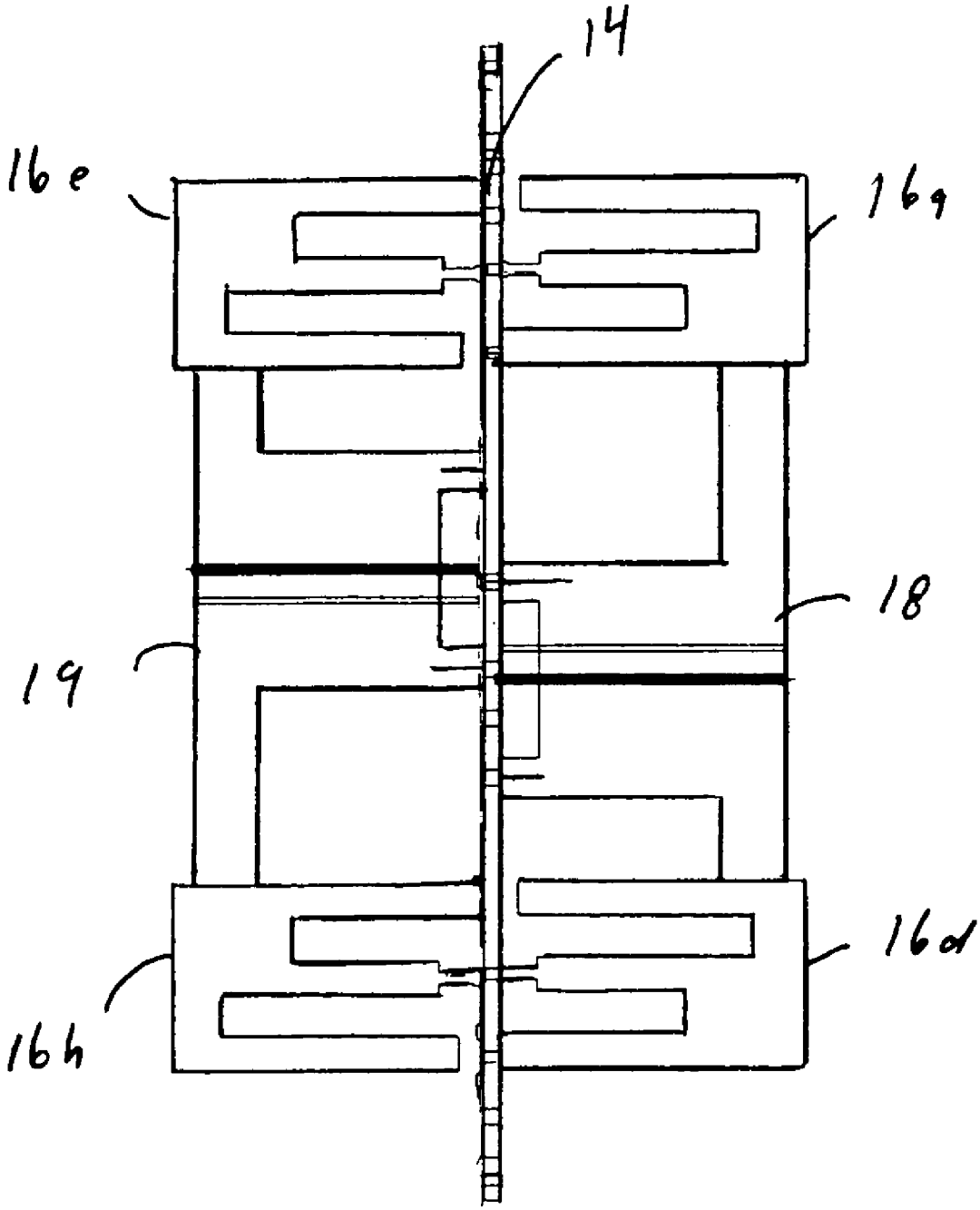
FIG. 1C is a side view of an antenna assembly with dipole antenna elements.

FIG. 1C depicts an embodiment in which each of the antenna elements has a complementary antenna element which allows the pair of elements to operate as a dipole. Alternatively, different types of antenna elements can be used, for example, patch or coil elements. The antenna assembly in FIG. 1C is the same as that in FIG. 1A except that each antenna element 16*a–d* includes a complimentary element 16*e–h* located on the opposite side of the base 10 and electrically coupled to the antenna element on the other side of the base 14. Further, there is a complementary reflector 19 located opposite the reflector 18. All of the elements on the bottom or opposite side of the base operate and function in the same manner as their counter parts on the other side. The switch can be located on either side and controls the antenna elements in dipole pairs. Alternatively, the switch can control each antenna element separately. Further, the reflective surface is not needed for this embodiment. This allows for a more compact design in terms of the dimensions of the base.

Figure 2:
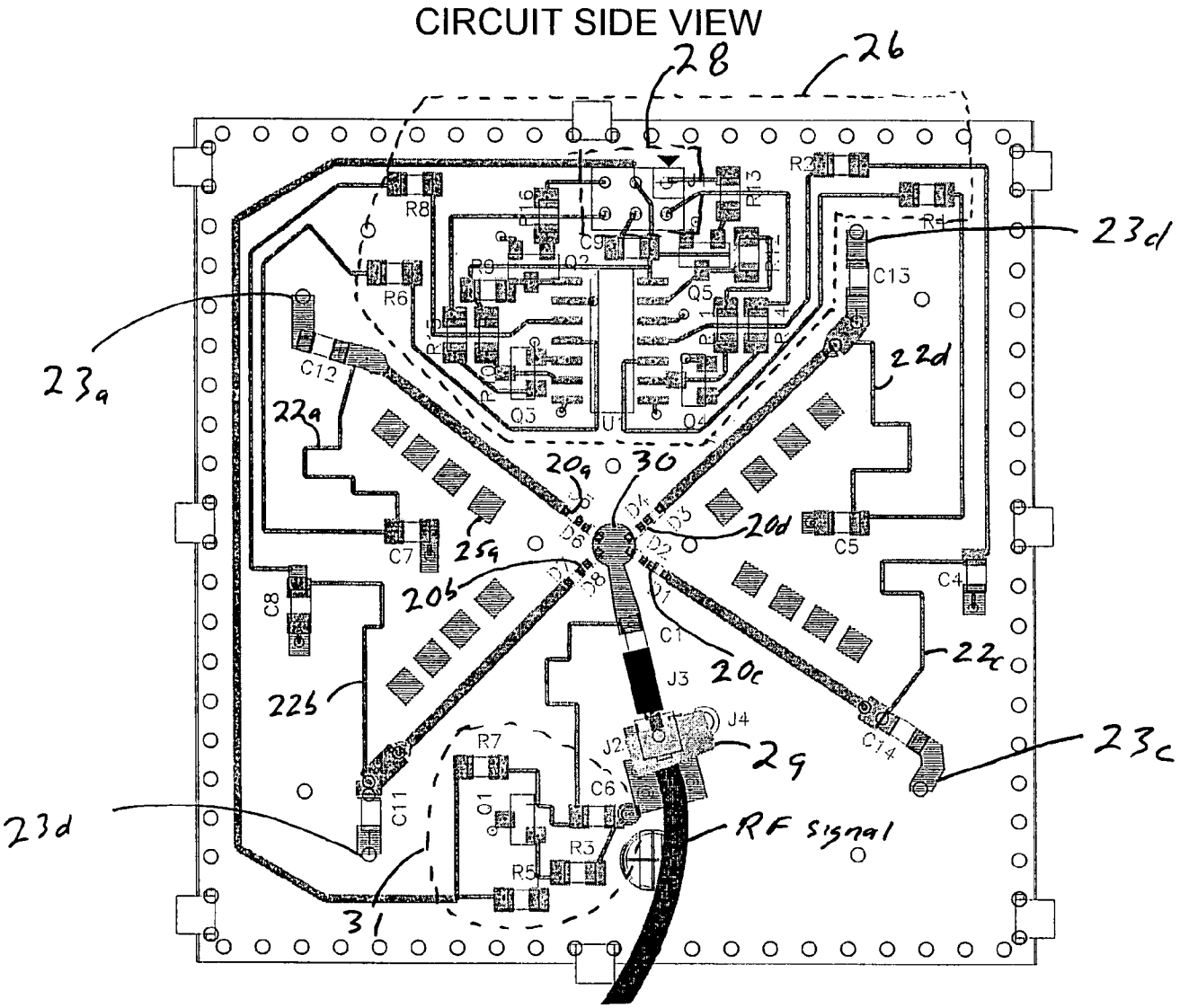
FIG. 2 is a plan view of the underside of the antenna assembly.

FIG. 2 is a plan view of the underside of the antenna assembly 10. In the embodiment depicted in FIG. 2, the switch 60 includes four pin diodes 20*a–d* and a control circuit 26. Each of the pin diodes is located in series on the trace 24*a–d* which leads to the connection 23*a–d* to the respective antenna element 16*a–d* (see FIG. 1A). A control line 22*a–d* runs from the end of the trace proximate the antenna element to the control circuit 26. An RF signal is supplied via connector 29 to the center point 30 which is coupled to each of the pin diodes.

The control circuit 26 receives a control signal via a connector 28. In one embodiment the control signal is a four line or four input control signal. In one embodiment, the control circuit converts a positive 3 volt direct current input signal to a 12 volt direct current signal which is applied to the control line. The 12 volt signal causes the associated pin diode to act as a short to the RF signal. A six volt virtual ground signal is supplied to the center point by the virtual ground circuit 31. The six volt virtual ground signal causes the pin diodes to provide a very good open condition when the 12 volt signal is not present and a ground signal is provided to the control line 22 by the control circuit 26.

In operation, each of the four input lines corresponds to one of the antenna elements 16*a–d*. When a 3 volt signal is present on a input line, the control circuit 26 supplies the 12 volt signal to the control line corresponding to that antenna element. When a zero volt signal is present on a input line, the control circuit provides a zero volt signal on the corresponding control line and the pin diode presents on open circuit to the antenna element.

Each of the traces coupling the antenna element to the pin diode has associated impedance tuning pads, for example tuning pad 25*a*. To create the desired impedance, one or more of the tuning pads can be shorted (electrically connected) to the trace. In addition, tuning pads can be shorted to each other in order to provide additional impedance tuning options.

The four antenna array described here can generate multiple beams for optimizing the antenna gain in various directions. Each monopole element can be individually fed by the switch to form single beams. These four beams will provide quadrant coverage around the antenna array. Adjacent pairs of monopole elements can be fed simultaneously to form corner arrays, which provide increased gain at the angular region between the individual beams of the two antennas. Opposing pairs of elements can be combined to provide coverage in the two opposing directions. All four elements can be fed simultaneously to provide omni-directional coverage. The same variations can also be used with antenna assemblies have more or fewer antenna elements, for example, antenna assemblies having two, three, five or six or more antenna elements.

Using a switch to activate individual antenna elements as well as combined elements presents a challenge when impedance matching the antenna/switch assembly. A common port which tees out to four ports, with pin diodes or other active components providing a connection or producing an open circuit in each branch is the circuit topology used in one embodiment. If the antenna element is impedance matched to the switch or switch assembly to provide the lowest mismatch loss when a single antenna element is activated, the mismatch loss for the case where a corner array is formed will increase when compared to the single antenna case. This is due to the impedance of the two ports combining in parallel to present the resultant impedance at the common port of the switch that is one-half the value of the impedance of the single port case. The same rationale applies to the reverse scenario, where the antenna elements have optimized impedance values to produce a minimum mismatch loss for the case when a corner array is formed. Overall antenna performance can be improved by matching the antenna impedance such that the mismatch loss is equal (meaning approximately equal) for the two cases described above, activating a single antenna element and combining two elements to form an array. By matching the antenna assembly in this fashion, the radiation efficiency is equalized across all of the beams, and the return loss of the antenna assembly will remain constant as different antenna beams are formed.

Figure 3:
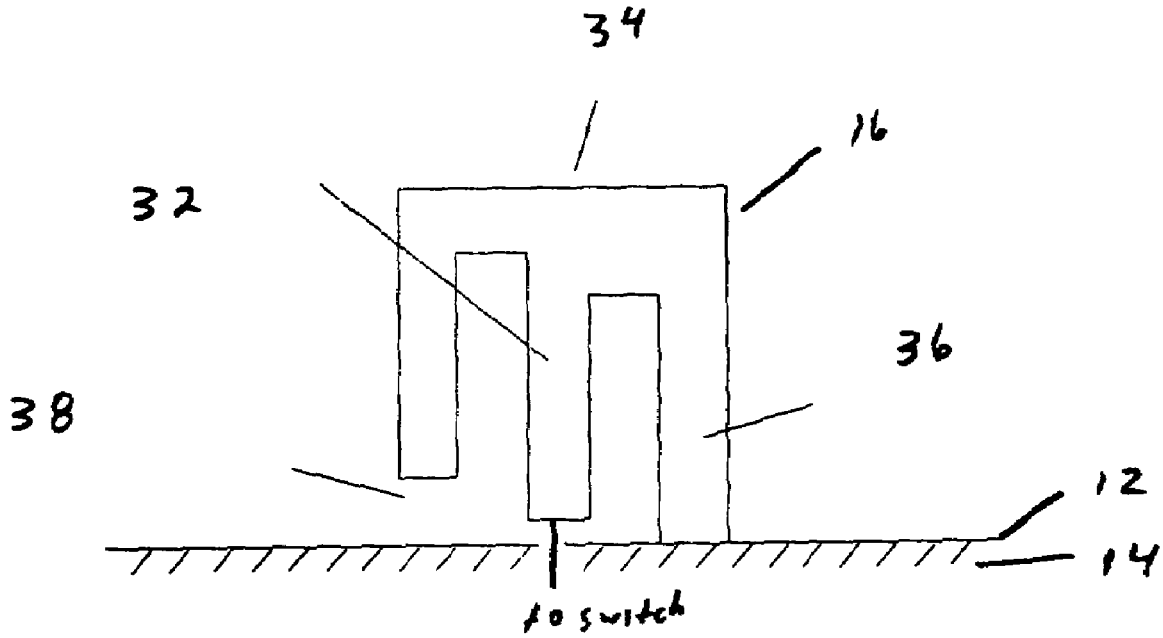
FIG. 3 is a detailed cross-section of a portion of the assembly of FIG. 1*a*.

FIG. 3 is a detailed view of the assembly 10 of FIGS. 1A–B showing one of the monopole elements 16 and a portion of the base 14 and reflective surface 12 in cross section. In this embodiment, the antenna element is a monopole element with a shape which resembles the letter "M" when viewed from the side. A center section 32 of the element 16 runs perpendicular to the reflective surface. Alternatively, different angles between the reflective surface and the center section 32 can be used, for example, eighty degrees or forty-five degrees. The center section 32 is coupled to the switch matrix at the end that approaches the reflective surface and is not coupled to the reflective surface. A top section 34 of the antenna element 16 is located at the end of the center section 32 opposite the reflective surface. The top section 34 branches to both sides of the center section 32. The top section 34 may run parallel or substantially parallel to the reflective surface. An inductive section 36 extends from the reflective surface to the top section 34. The inductive section can be parallel to the center section 32. The inductive section 36 is short circuited to the reflective surface 12. A capacitive section 38 extends towards the reflective surface 12 from the end of the top section 34 opposite to the inductive section 36. The capacitive section 38 can be parallel to the center section 32. The capacitive section 38 ends prior to making contact with the reflective surface. The inductive section 36 and the capacitive section 38 act as inductive and capacitive components, respectively, that can be adjusted to impedance match the antenna element 16 as needed by the requirements of the system in which it will be used. The inductive element 36 forms an inductive loop when combined with its image generated by the reflective surface. The capacitive section 38 forms a capacitive section at the reflective surface.

The configuration of the antenna element 16 described above can allow for the overall size (principally the height) of the antenna element 16 to be made smaller without a significant reduction in performance due to the reactive loading generated by these inductive and capacitive sections. The reduction in height can be quite important when the assembly 10 (see FIG. 1A) is placed within an enclosure, for example, a plastic enclosure. For example, the arrangement described above can minimize the contact between the antenna elements 12*a–d* and the plastic enclosure commonly used in wireless local area network (WLAN) communication devices. Preferably, the antenna elements do not touch the plastic enclosure. Most of the antenna element 16 is perpendicular to the reflective surface 12. The reflective surface is typically parallel to the adjacent wall of the enclosure. Therefore, very little of the antenna element 12 is available to come into contact with the wall of the enclosure.

This is an advantageous feature since the close proximity of the plastic enclosure to the antenna element reduces the frequency of operation of the antenna element. This detuning of the antenna element is a common occurrence in embedded antenna applications. The antenna element must be dimensioned and tuned to resonate at a higher frequency than the intended frequency prior to insertion of the antenna assembly into the plastic enclosure, with a prior knowledge of the dielectric constant of the plastic material, its thickness, and distance from the antenna elements needed to insure a successful impedance match of the antenna assembly after embedding in the plastic enclosure. This "M" shaped antenna element 12 does not de-tune when placed inside the plastic enclosure, making this a robust design for applying to a wide variety of WLAN devices.

Figure 4:
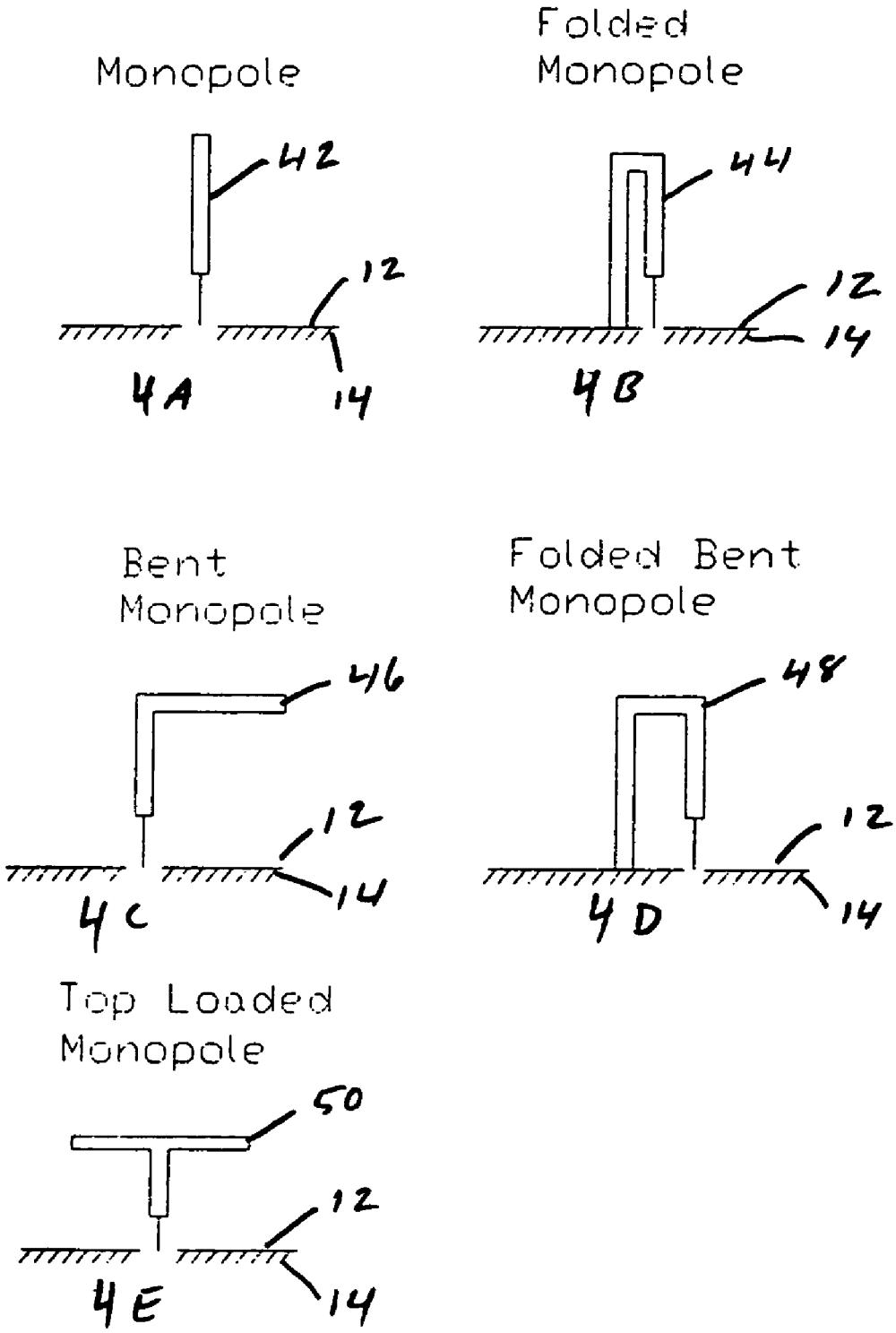
FIGS. 4A–E are side views of alternative configurations of monopole elements.

FIGS. 4A–E are side views of alternative configurations of monopole elements that can be used to accommodate a wide variety of applications. Each of the monopole elements in FIGS. 4A–E are shown mounted to the base 14 above the reflective surface 12. FIG. 4A depicts a straight monopole element 42. FIG. 4B depicts a folded monopole 44. FIG. 4C depicts a bent monopole 46. FIG. 4D depicts a folded bent monopole 48. FIG. 4E depicts a top loaded monopole 50. These monopoles can be used in place of the "M" shaped monopole elements 16*a–d* shown in FIG. 1A. In particular, in situations where sufficient height is available, the monopole element can be a traditional monopole or a folded monopole. The choice between the two provides an option for higher antenna impedance (folded monopole) for switch topologies that require a high terminating impedance. A resonant monopole is on the order of 0.20 to 0.25 wavelengths in length. When the application requires a reduced height approach, the monopole element can take other forms: a bent monopole, a bent folded monopole, or a top loaded monopole for example.

Figure 5:
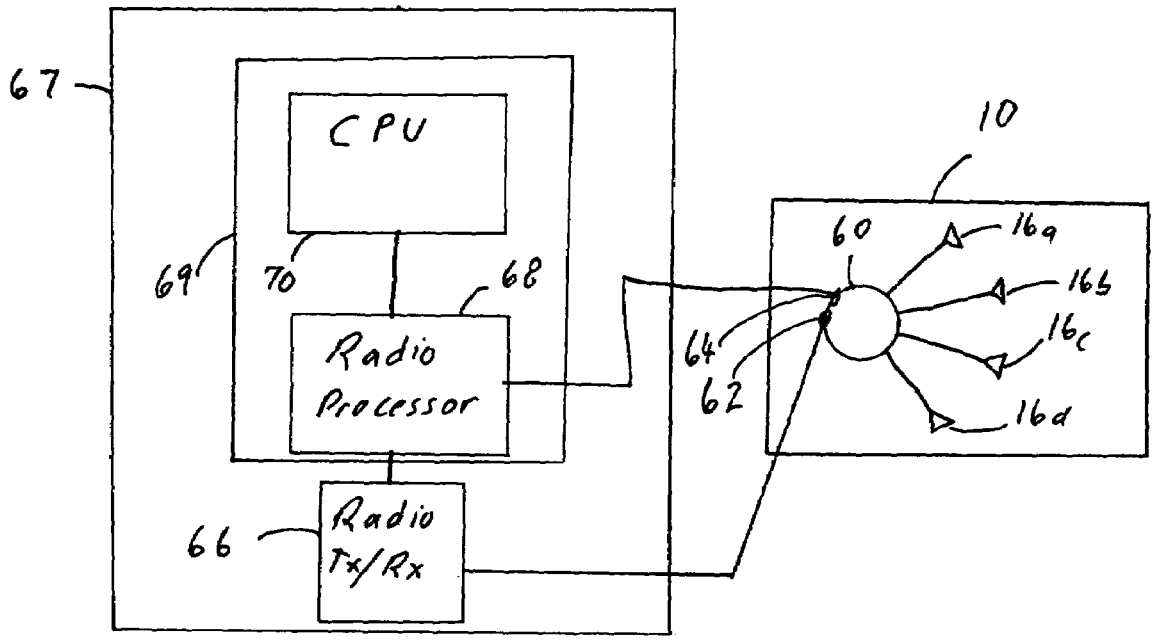
FIG. 5 is a schematic block diagram representation of a wireless communication device.

FIG. 5 is a schematic block diagram representation of a wireless communication device utilizing the antenna assembly 10. For example, the wireless communication device can be a wireless router, a cellular telephone, a wireless communication card for a portable computer or any other type of wireless communication device. The device includes a housing which is not shown. The switch 60 can be a pin diode type switch as described above. Other suitable switches can be used, for example, transistor switches and micro-electromechanical switches. The switch 60 is configured to couple the output 62 of the switch to one or more of the antenna elements 16*a–d*. The output 62 can be coupled to a radio receiver/transmitter subassembly 66. The switch 60 receives control signals at its control input 64. The control signal may be sent from a radio processor subassembly 68. The signals received at the control signal input 64 of the switch 60 control the operation of the switch. For example, the control signals can cause the switch to couple its output port 62 to one or more of the antenna elements 16*a–d*. The wireless communication device also typically includes a central processing unit 70. It is also possible to configure the system such that the control signals to the control signal input port 64 of the switch 60 are sent from the central processing unit 70. The central processing unit 70 and the radio processor subassembly 68 are collectively referred to as the controller 69. In general, it is the controller 69 which controls the switch 60. The non-antenna elements of the wireless communication device are enclosed within box 67. It should be understood that in general the non-antenna elements 67 are coupled to the output 62 of the switch 60 and to the control signal port 64 of the switch but that the non-antenna elements 67 can be configured in various manners and arrangements without departing from the scope of the present invention.

When using mono-pole type antenna elements, a reflective surface is typically required for operation. To provide efficient radiation into the hemisphere above the plain in which the reflective surface is positioned, the dimensions of the reflective surface are typically on the order of one wavelength or greater per side (if the reflective surface is rectangular in shape). A reflective surface with smaller dimensions impairs the ability of the image of the antenna element formed by the reflective surface to properly form. In addition, excess radiation in the hemisphere below the reflective surface can occur in such situations which reduces the directivity of the antenna element in the direction of the upper hemisphere. While it can be advantageous to have a reflective surface with dimensions on the order of at least one wavelength. Alternatively, directors can be added to the side of the reflective surface 10 opposite the antenna elements 16*a–d* in the embodiment shown in FIG. 1A to assist in modifying the antenna beam characteristics.

Figure 6:
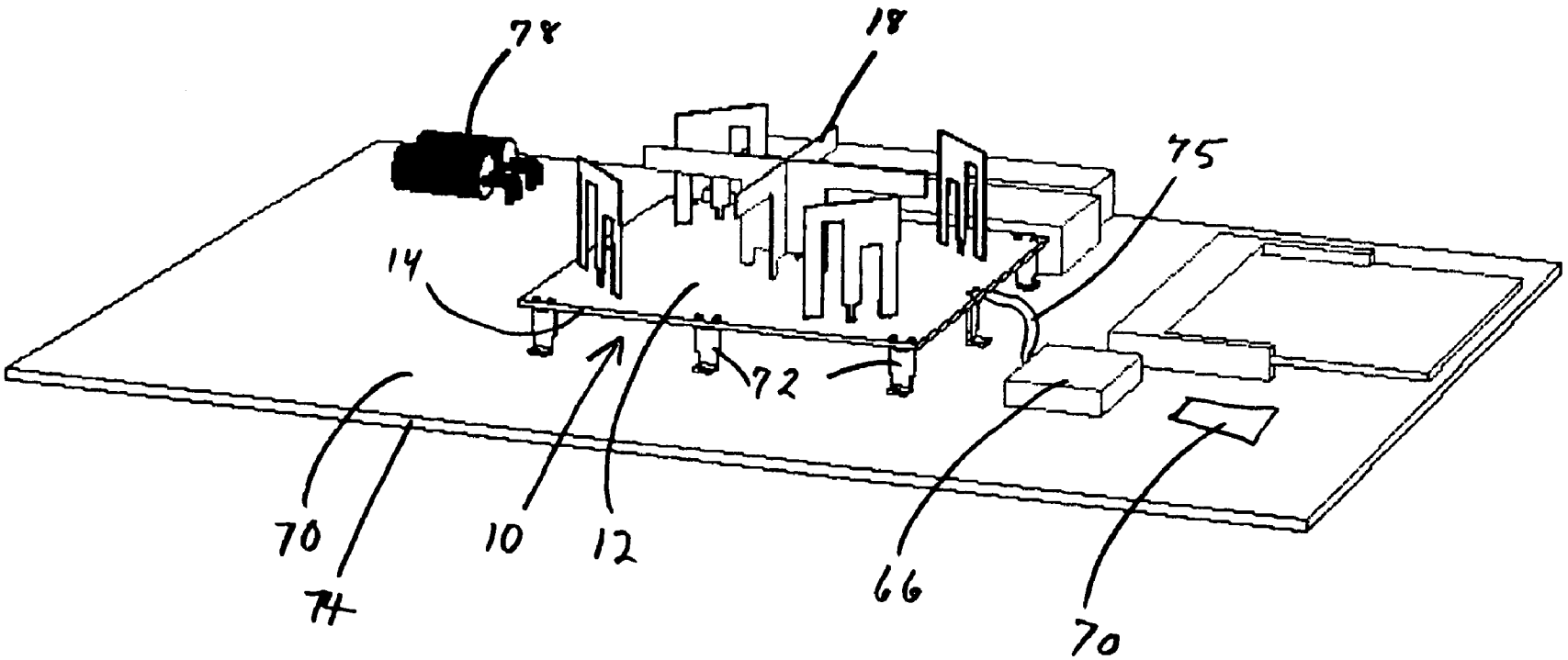
FIG. 6 is a perspective view of an antenna element coupled to secondary reflective surface.

As was noted earlier, the reflective surface does not need to be formed of a single conductive element located in a single plane. For example, referring to FIG. 6, the antenna element 10 of FIG. 1A having a reflective surface 12 is shown coupled to a larger secondary reflective surface 70. In operation, the reflective surface 12 and the secondary reflective surface 70 act as a single reflective surface. In the embodiment depicted in FIG. 7, reflective surface 12 of the antenna element 10 may have the length of its sides being less than one wavelength of the RF for which the assembly is optimized. The secondary reflective surface 70 can be the ground layer of a printed circuit board 74 or some other metal surface. The reflective surface 12 of the antenna assembly 10 is electrically coupled (shorted) to the secondary reflective surface by a series of electrically conducting stand-offs 72. Alternatively, the coupling can be capacitive or inductive. The stand-offs 72 can be biased against contacts on the printed circuit board 74, for example by a mechanical coupling mechanism such as a clamp or a threaded fastener. This eliminates the need to solder the standoffs to the printed circuit board 74. Therefore, the space on the printed circuit board under the assembly 10 can be used for components that need to be tested after soldering. The assembly 10 can be mechanically attached after that.

The number of stand-offs used can be varied. Maintaining a spacing between the stand-offs 72 of approximately ⅕ of a wavelength or less can improve the performance of the system. Coupling the reflective surface 10 to the secondary reflective surface 70 can be thought of as forming a composite reflective surface with which the antenna elements 16*a–d* and the reflector 18 cooperate for transmission. The embodiment depicted in FIG. 6 allows for the antenna element to have a reduced size without losing the benefits of a larger reflective surface. This can be particularly advantageous when the secondary reflective surface 70 is the ground layer or ground plane of a circuit board 74 used in a wireless communication device such as the device depicted in FIG. 5.

When the secondary reflective surface is formed on the printed circuit board of a communication device, the elements of the communication device can adversely effect the operation of the antenna assembly 10. The electrical leads to certain elements such as the central processing unit 70 (see FIG. 5) can resonate with the transmissions of the antenna assembly and drain off transmitted signal strength. Therefore, those leads are placed under the ground plane layer 70 of the printed circuit board 74. Similarly, placing as much ground plane as possible on the top surface of the circuit board 74 will provide better performance and better shielding of elements below that surface. Similarly, elements which resonate can also be shielded, for example, by using a shielded cover. For example, covering all unused surface area with ground plane is beneficial.

In addition capacitors with very little capacitance, for example 15–20 pico-farads, can be placed in series with wires or traces that resonate. That minimizes the resonating and does not interfere with the operation of the other devices in the system which operate at a lower frequency than the RF frequency transmitted by the antenna assembly. For example, the wires contained within an RJ-45 connector may resonate and that resonation can be minimized by placing the proper capacitance in series with those wires. Additionally, large elements on the circuit board 74, for example, capacitors 78, are positioned as far as possible from the antenna elements 16*a–d* and the reflective surface 12 to minimize interference with the RF transmission The radio 66 is shown in this embodiment as a PCI card mounted on the circuit board 74 and coupled to the antenna assembly by a coaxial cable 75. Alternatively, the radio can be assembled on the bottom side of the base 14 of the antenna assembly 10. Additionally, in one embodiment, the radio is mounted directly on the board 74.

Figure 7:
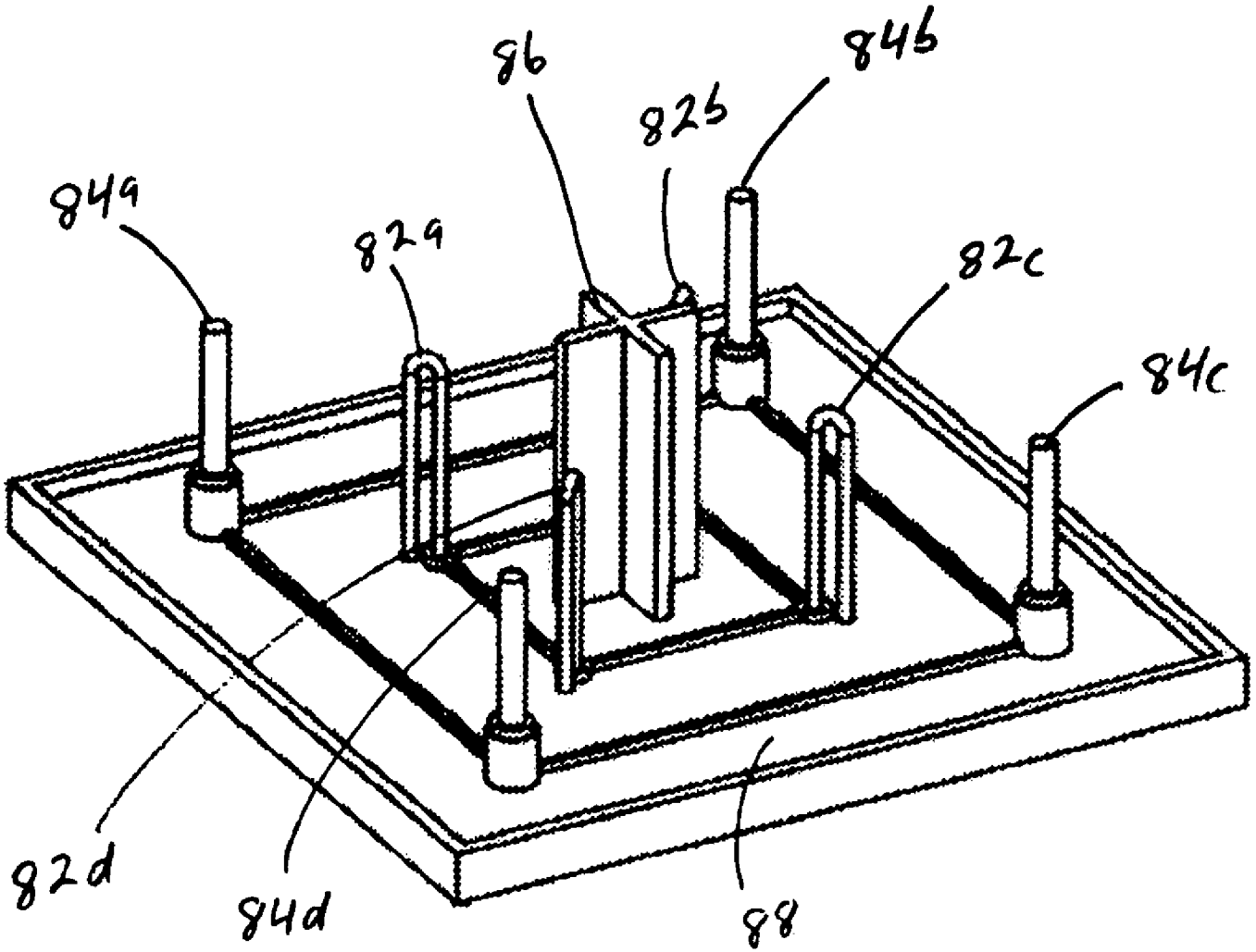
FIG. 7 is a perspective view of a four element antenna assembly with directors.

FIG. 7 is a perspective view of an alternative embodiment of the antenna assembly. In the assembly shown in FIG. 7, each antenna element 82*a–d* has an associated director 84*a–d*. The common reflector 86 is configured as a simple cross piece. A reflective surface 88 is a ground plane. In the embodiment depicted in FIG. 7, the monopole antenna elements are approximately ¼ wavelength in length. The reflector 86 is approximately five percent longer than the antenna element and the directors are approximately five percent shorter in length than the antenna elements. This antenna assembly can be used in the wireless communication device depicted in FIG. 5 and can utilize the switch described in FIGS. 2 and 5.

The above description of the disclosed embodiments is provided to enable any person skilled in the art to make or use the invention. Various modifications to these embodiments will be readily apparent to those skilled in the art, and the principles defined herein can be applied to other embodiments without departing from the spirit or scope of the invention. Thus, the invention is not intended to be limited to the embodiments shown herein but is to be accorded the widest scope consistent with the principles and novel features disclosed herein.

What is claimed is:

1. An antenna system comprising:

a reflective layer having an upper surface and a lower surface;

a plurality of antenna elements proximate the upper surface of the reflective layer;

one or more reflectors electrically coupled to the reflective layer and positioned to operate as a reflector for each of the plurality of antenna elements; and a switch coupled to each of the plurality of antenna elements and configured to select an active state or inactive state for each of the plurality of antenna elements;

wherein the reflective layer comprises a primary reflective surface to which the plurality of antenna elements are located proximate and a secondary reflective surface.

2. The system of claim 1 further comprising a plurality of electrically conductive standoffs coupling the primary reflective surface to the secondary reflective surface.

3. The system of claim 1 wherein the switch is configured to select an active state for more than one antenna element at one time.

4. The system of claim 1 further comprising a radio coupled to the switch.

5. The system of claim 4 wherein the radio is located proximate the lower side of the reflective surface.

6. An antenna system comprising:

a reflective layer having an upper surface and a lower surface;

a plurality of antenna elements proximate the upper surface of the reflective layer;

one or more reflectors electrically coupled to the reflective layer and positioned to operate as a reflector for each of the plurality of antenna elements; and a switch coupled to each of the plurality of antenna elements and configured to select an active state or inactive state for each of the plurality of antenna elements, wherein each of the plurality of antenna elements comprises:

a center section coupled to the switch at a first end of the center section proximate the reflective layer;

a top section extending from a second end of the center section opposite the first end of the center section;

an inductive section extending from the reflective layer to the top section; and a capacitive section extending from the top section towards the reflective layer.

7. An antenna system comprising:

a base layer;

a ground plane formed on the base layer and having an upper surface and a lower surface proximate the base layer;

a plurality of antenna elements coupled to the base proximate the upper surface of the ground plane and extending outwardly from the ground plane;

a reflector electrically coupled to the ground plane and positioned to operate as a reflector for each of the plurality of antenna elements, each of the antenna elements in cooperation with the reflector having a direction of transmission;

a switch on the base on a side opposite to the plurality of antenna elements, coupled to each of the plurality of antenna elements and configured to select an active state or inactive state for each of the plurality of antenna elements; and a secondary reflective surface electrically coupled to the ground plane.

8. The system of claim 7 further comprising a plurality of electrically conductive standoffs coupling the ground plane to the secondary reflective surface.

9. The system of claim 7 wherein the switch is configured to select an active state for more than one antenna element at one time.

10. The system of claim 7 further comprising a radio coupled to the switch.

11. The system of claim 10 wherein the radio is located on the base proximate the lower side of the ground plane.

12. An antenna system comprising:

a base layer;

a ground plane formed on the base layer and having an upper surface and a lower surface proximate the base layer;

a plurality of antenna elements coupled to the base proximate the upper surface of the ground plane and extending outwardly from the ground plane, each of the plurality of antenna elements comprising a center section coupled to the switch at a first end of the center section proximate the ground plane, a top section extending from a second end of the center section opposite the first end of the center section, an inductive section extending from the ground plane to the top section, and a capacitive section extending from the top section towards the ground plane;

a reflector electrically coupled to the ground plane and positioned to operate as a reflector for each of the plurality of antenna elements, each of the antenna elements in cooperation with the reflector having a direction of transmission; and a switch on the base on a side opposite to the plurality of antenna elements, coupled to each of the plurality of antenna elements and configured to select an active state or inactive state for each of the plurality of antenna elements.

13. A method of manufacturing an antenna assembly comprising:

providing a base layer having an upper surface and a lower surface;

forming a primary reflective surface on the base layer;

providing a plurality of antenna elements proximate the upper surface of the base layer;

providing one or more reflectors proximate the upper surface of the base layer positioned to operate as a reflector for each of the plurality of antenna elements and electrically coupling the one or more reflectors to the primary reflective surface;

coupling a switch, configured to select an active state or inactive state for each of the plurality of antenna elements in response to a control signal, to each of the plurality of antenna elements;

matching the impedance of each of the plurality of antenna elements to the switch; and adjusting the impedance of an antenna element by shorting one or more impedance tuning pads to the antenna element.

14. A method of manufacturing an antenna assembly comprising:

providing a base layer having an upper surface and a lower surface;

forming a primary reflective surface on the base layer;

providing a plurality of antenna elements proximate the upper surface of the base layer;

providing one or more reflectors proximate the upper surface of the base layer positioned to operate as a reflector for each of the plurality of antenna elements and electrically coupling the one or more reflectors to the primary reflective surface;

coupling a switch, configured to select an active state or inactive state for each of the plurality of antenna elements in response to a control signal, to each of the plurality of antenna elements;

matching the impedance of each of the plurality of antenna elements to the switch; and shorting one or more impedance tuning pads to each other.

15. A method of manufacturing an antenna assembly comprising:

providing a base layer having an upper surface and a lower surface;

forming a primary reflective surface on the base layer;

providing a plurality of antenna elements proximate the upper surface of the base layer;

providing one or more reflectors proximate the upper surface of the base layer positioned to operate as a reflector for each of the plurality of antenna elements and electrically coupling the one or more reflectors to the primary reflective surface;

coupling a switch, configured to select an active state or inactive state for each of the plurality of antenna elements in response to a control signal, to each of the plurality of antenna elements; and electrically coupling a secondary reflective surface to the primary surface.

* * * * *